US007814927B2

(12) United States Patent
Hansen

(10) Patent No.: US 7,814,927 B2
(45) Date of Patent: Oct. 19, 2010

(54) FAUCET WITH ACCESSIBLE WATERWAY ASSEMBLY

(75) Inventor: David E. Hansen, Howards Grove, WI (US)

(73) Assignee: Kohler Co., Kohler, WI (US)

( * ) Notice: Subject to any disclaimer, the term of this patent is extended or adjusted under 35 U.S.C. 154(b) by 456 days.

(21) Appl. No.: 12/055,609

(22) Filed: Mar. 26, 2008

(65) Prior Publication Data

US 2009/0242058 A1 Oct. 1, 2009

(51) Int. Cl.
*F16K 21/00* (2006.01)

(52) U.S. Cl. ..... 137/315.12; 137/454.6; 137/801

(58) Field of Classification Search ..... 137/315.12, 137/315.13, 801, 454.5, 454.6
See application file for complete search history.

(56) References Cited

U.S. PATENT DOCUMENTS

| | | | | |
|---|---|---|---|---|
| 6,289,531 | B1 | 9/2001 | Kahle et al. | |
| 6,371,163 | B1 | 4/2002 | Kahle et al. | |
| 6,757,921 | B2 | 7/2004 | Esche et al. | |
| 6,807,983 | B1 | 10/2004 | Erickson | |
| 7,104,473 | B2 * | 9/2006 | Bosio | 239/449 |
| 7,264,016 | B2 * | 9/2007 | Molina et al. | 137/454.6 |
| 7,353,838 | B2 * | 4/2008 | Schmitt et al. | 137/315.12 |
| 7,533,683 | B2 | 5/2009 | Ortega et al. | |
| 2004/0010848 | A1 | 1/2004 | Esche | |
| 2008/0163933 | A1 | 7/2008 | Ortega et al. | |

FOREIGN PATENT DOCUMENTS

WO WO 2008/086379 7/2008

OTHER PUBLICATIONS

Press Release of Price Pfister "Hanover" faucet from luxurylaunches.com, dated Jan. 29, 2007.
Five pages of International Search Report excerpts from PCT/US2009/001862, a counterpart PCT application, dated Jul. 21, 2009.

* cited by examiner

*Primary Examiner*—Kevin L Lee
(74) *Attorney, Agent, or Firm*—Quarles & Brady LLP

(57) ABSTRACT

Disclosed are faucets having a housing with a hollow main body, a lower inlet, a hollow side arm, and an upper outlet. A control valve is mounted to the side arm. A waterway subassembly is removably mounted in the main body using a catch located in the side arm which is accessible from outside the side arm and moveable between a first position that prevents the waterway from dropping out of the housing lower inlet and a second position that permits the waterway to drop out of the housing lower inlet.

9 Claims, 5 Drawing Sheets

FAUCET WITH ACCESSIBLE WATERWAY ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to faucets having an upwardly extending spout and a control valve mounted along the side of the spout body. More particularly, it relates to an assembly for removably attaching a waterway to such a faucet.

Many faucets have a main body that extends substantially vertically upwardly. There is typically a fixed spout, or a pull-out type spout, at the upper end of the body, and preferably also a control valve mounted along the side of the body. See e.g. U.S. Pat. Nos. 6,289,531, 6,371,163, and 6,757,921.

Such control valves are typically linked to a lever or other control handle. Moving the handle moves a disk or other element in the control valve, which in turn regulates the flow of water through the valve (and typically also the temperature of the water).

These faucets have a hot water supply line, a cold water supply line, and a mixed water line that carries water from the control valve to the spout outlet. A variety of techniques and assemblies have been used to attach these varied lines.

In this regard, some faucets have a bulky receptor area integrated with the faucet body such that the lines are received in machined or otherwise formed integral bores of the body. However, these assemblies use large amounts of metal, and may add complexity to the manufacturing process.

Other faucets use a pre-formed waterway subassembly consisting of an elbow, two inlet lines and an outlet line linked to a downward face of the elbow. A vertical face of the elbow is designed to abut a valve control cartridge or the like.

This type of waterway can be difficult to assemble to the faucet body in an efficient fashion. For example, in U.S. Pat. No. 6,757,921 the waterway is threaded through the side arm such that the elbow catches in the side arm and the lines then drop out the bottom of the body. Handling elongated lines during this assembly method can add complexity. Further, attempting to ease this assembly procedure by widening the area of the body adjacent the intersection with the side arm places limitations on the aesthetics of the design.

Inserting the waterway from the bottom of the faucet can complicate securing the waterway in place. Where the waterway is welded in place, separate maintenance of the waterway cannot be achieved thereafter.

Hence, a need still exists for improved faucet assemblies where the waterway can be efficiently installed, yet can be readily removed, when desired, for maintenance or replacement purposes.

SUMMARY OF THE INVENTION

The present invention provides a faucet of a type having a housing with a hollow main body, a lower inlet, a hollow side arm, and an upper outlet. A control valve is mounted to the side arm. A waterway is removably mounted in the main body. The waterway has at least one inlet line, a waterway face positionable adjacent the control valve, and an outlet line.

The improvement is providing a catch located in the side arm which is accessible from outside the side arm and moveable between a first position that prevents the waterway from dropping out of the housing lower inlet and a second position that permits the waterway to drop out of the housing lower inlet. The catch may be in the form of a rotatable sleeve. The rotatable sleeve may have a projection and the waterway face may have an undercut.

In a preferred form the projection of the rotatable sleeve may grip the undercut of the waterway face when the projection is in a first rotational position. Thus, the catch may form a part of a bayonet-type assembly.

According to other preferred aspects of the invention, the control valve may be in the form of a valve cartridge located in the side arm radially inward of the catch. A face of the valve cartridge may abut the waterway face. The faucet may also have a bonnet nut that secures the valve cartridge in the side arm. The waterway may have two inlet lines linked to an elbow.

The present invention permits the waterway to be inserted axially up from the bottom of the faucet body. A rotatable sleeve in the side arm can be positioned to catch behind the elbow and trap it in place. The valve body and control handles can then be mounted in the side arm to complete the assembly.

Hence, installation is highly efficient. Yet, if the waterway thereafter needs to be maintained or replaced one can remove the handle and control cartridge, rotate the catch sleeve, and cause the waterway to simply drop down out of the faucet body. This permits access to the waterway without any need to remove the faucet from the counter top.

The waterway can be inexpensively manufactured (e.g. from a metal such as brass, or a plastic), and that the use of the rotatable sleeve does not materially affect the cost of the final product. Further, this assembly is sufficiently intuitive that a consumer who is not a skilled plumber can quickly learn how to disassemble the waterway from brief instructions.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
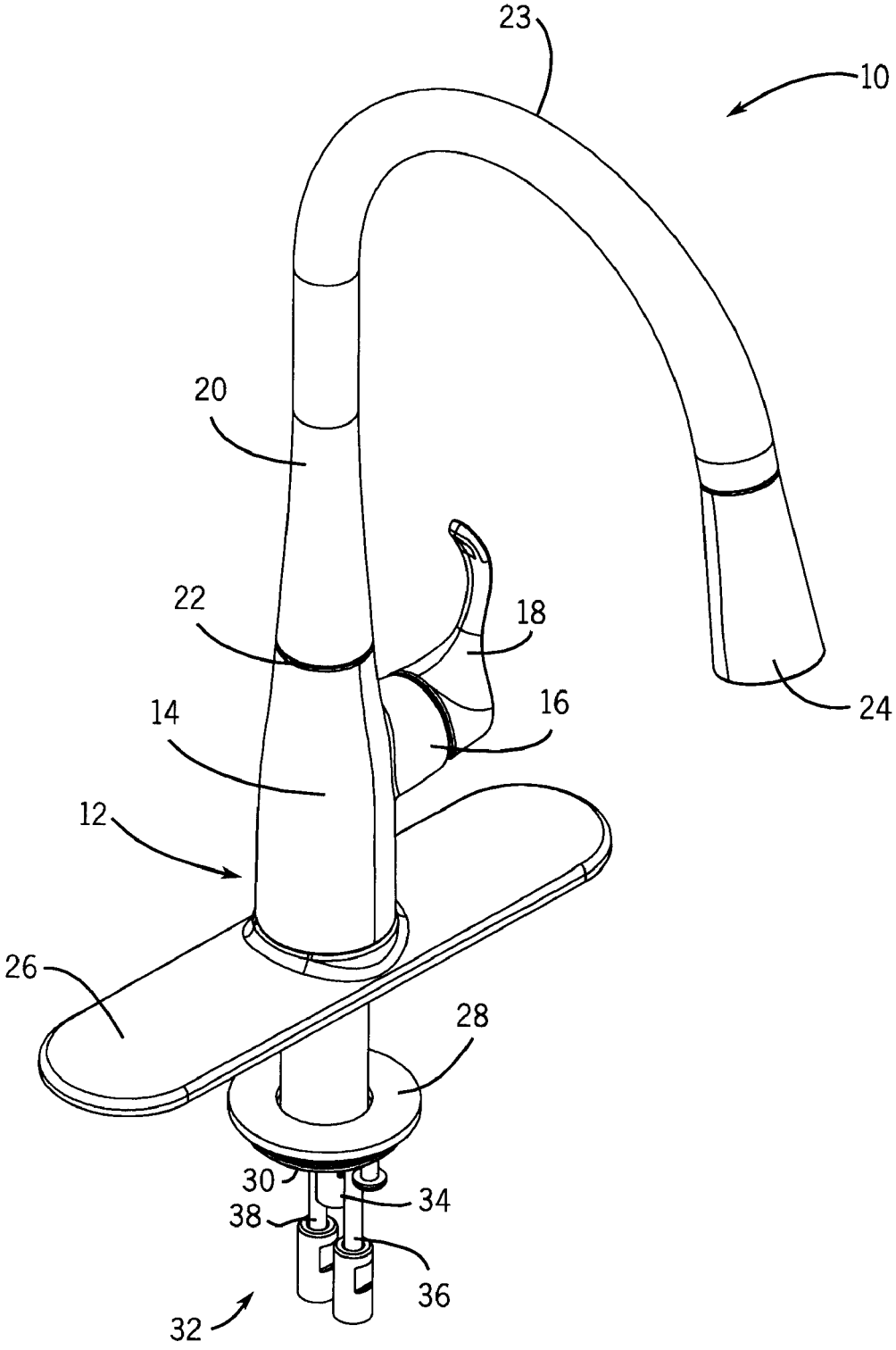
FIG. 1 is a perspective view of a faucet of the present invention.
Figure 2:
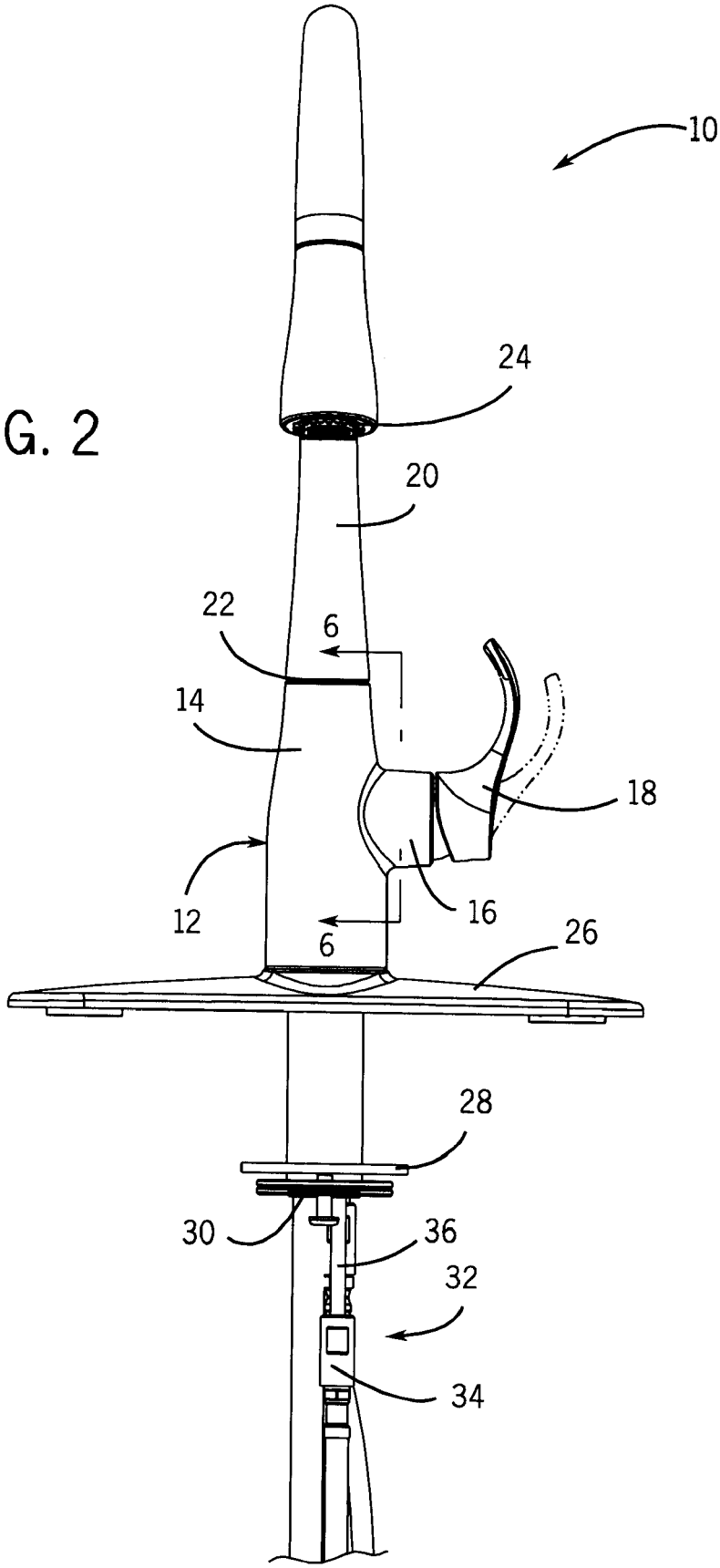
FIG. 2 is a front plan view thereof.
Figure 3:
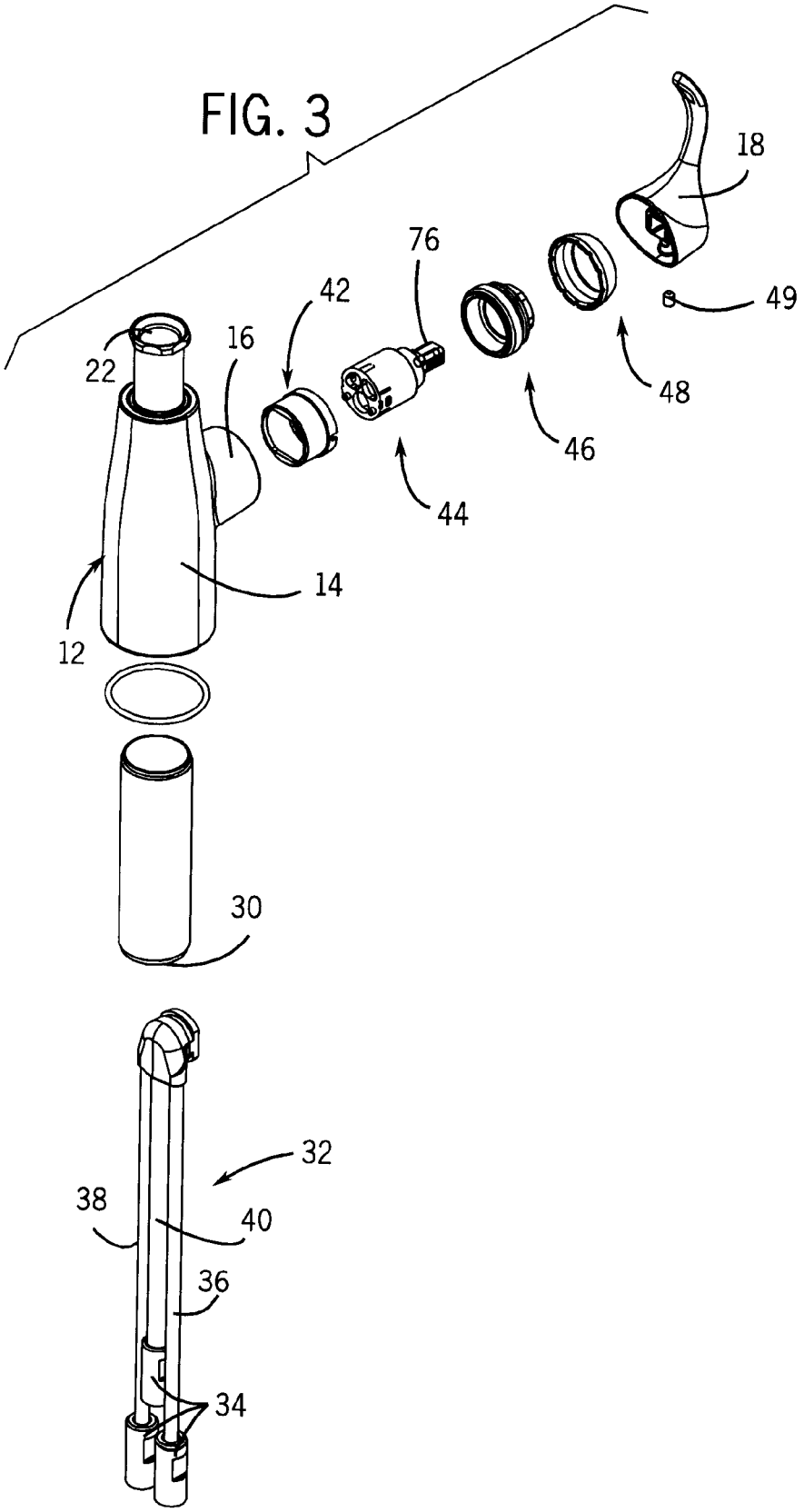
FIG. 3 is an exploded perspective view of portions of the FIG. 1 faucet.

Referring now to FIGS. 1, 2 and 3, faucet 10 is shown having a housing 12 with a hollow main body 14 having a hollow side arm 16 to which a control handle 18 is attached. The body 14 has on top of it a neck 20 extending up from a junction 22. The neck then leads to a U-shaped spout 23 and ultimately spray head 24.

A lower escutcheon or base 26 decorates the base of the faucet, and sits on a sink, counter top or the like (not shown). Below the escutcheon 26, a nut 28 may be positioned around a lower inlet section 30 such that the faucet 10 may be secured to a sink.

The assembly also has a waterway 32 having quick attach type connectors 34 at the ends of a hot water inlet line 36, a cold water inlet line 38, and a mixed water outlet line 40. Water supply pipes will be linked to lines 36 and 38 from room water supplies. Also, a tube will be linked to the line 40 to bend back up and through the spout 23 to a spray head 24.

Figure 7:
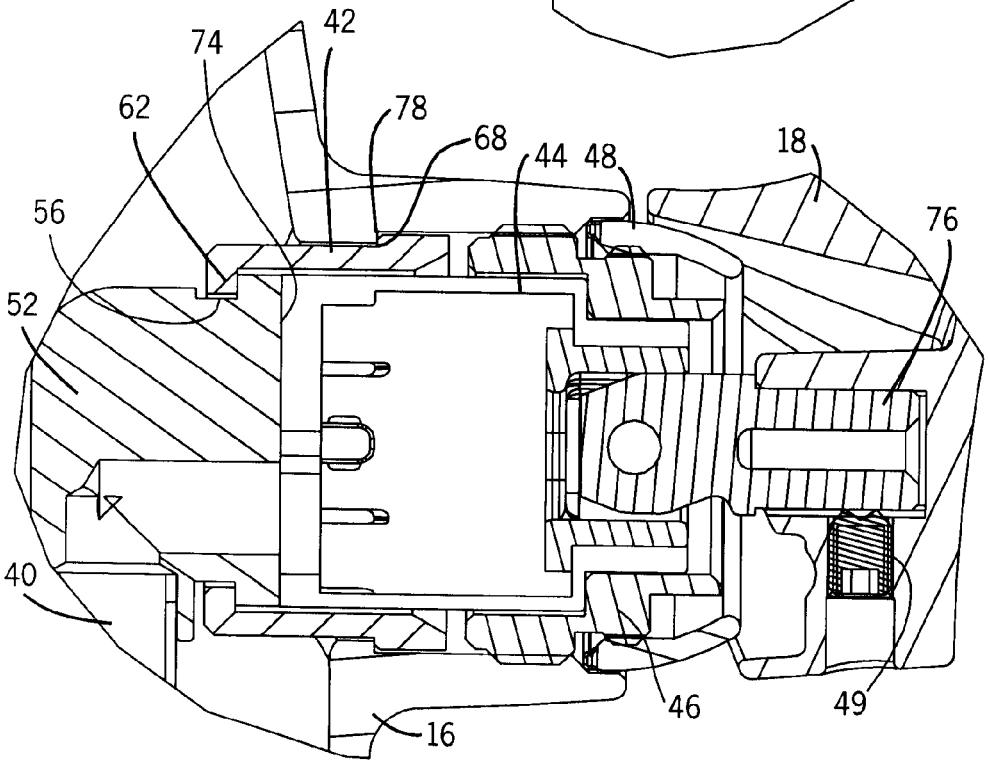
FIG. 7 is an enlarged cross-sectional view of a side arm portion of the faucet of FIG. 1.

As can be most clearly seen in FIGS. 3 and 7, the hollow side arm 16 includes a sleeve form catch 42, a control valve cartridge 44, a bonnet nut 46, a bonnet 48, and a set screw 49 that secures the handle 18 to a valve stem 76 of the control valve cartridge 44. The control valve cartridge 44 may be of any conventional type. However, as shown, the control valve cartridge 44 is a mixing valve for mixing the hot water inlet line 36 and the cold water inlet line 38 and also controlling the flow rate. The resultant mixed water is outputted to the mixed water outlet line 40.

Figure 4:
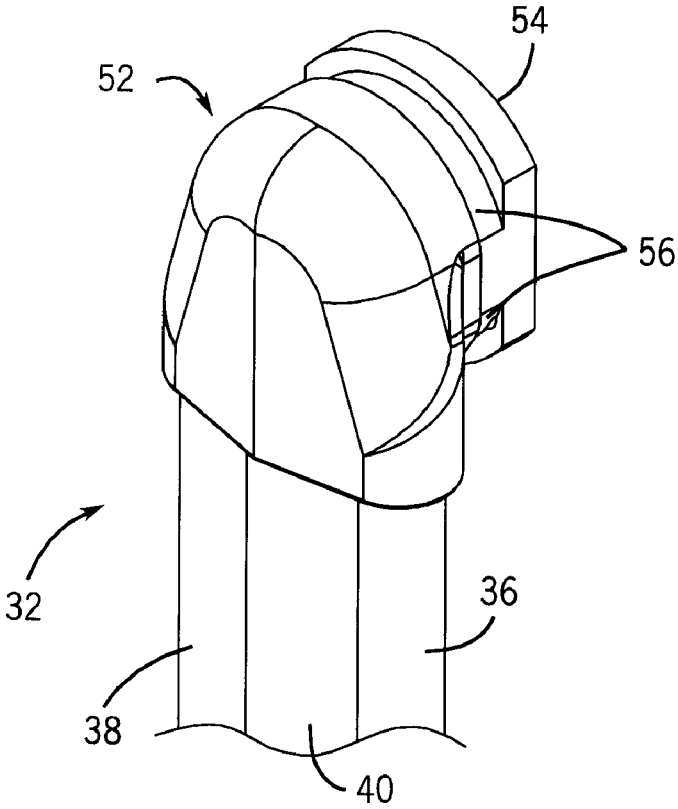
FIG. 4 is an enlarged perspective view of the top of a preferred waterway of the present invention.

The upper end of the waterway 32 has an elbow 52, as best shown in FIG. 4. This elbow 52 bends the direction of flow from the vertical inlet lines to a waterway face 54 which abuts the valve cartridge.

Figure 5:
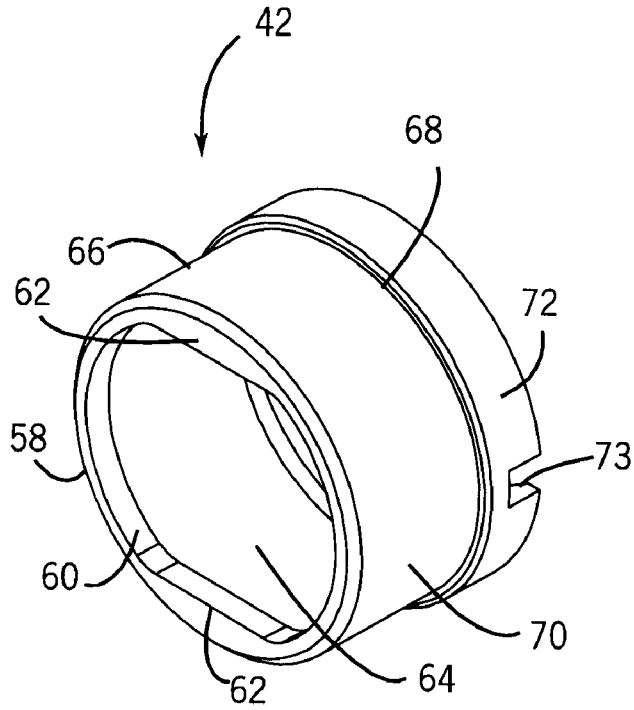
FIG. 5 is an enlarged perspective view of a preferred catch of the present invention in the form of a rotatable sleeve.

Preferably, an undercut 56 is formed behind the waterway face on the elbow. As can be best seen in FIG. 5, the catch 42 has a catch face 58. The catch face 58 has a cutout 60 defining a set of projections 62 on opposing sides of the cutout 60. The cutout 60 is slightly larger than the profile of the waterway face 54 such that the cutout 60 can receive the waterway face 54 in inserted fashion. The cutout 60 on the catch face 58 also provides access to an inner bore 64 of the catch 42.

On the outer periphery 66 of the catch 42 is a radial flange 68. As shown, the flange 68 is in the form of a step such that a portion 70 of the outer periphery 66 of the catch 42 is radially inset from portion 72 of the outer periphery 66.

The catch 42 also includes a pair of axial slots 73 that are formed on a face opposite the face having the set of projections 62. The slots 73 may be used to facilitate rotation of the catch 42 once the catch 42 is inserted into the hollow side arm 16 using a tool.

Figure 6:
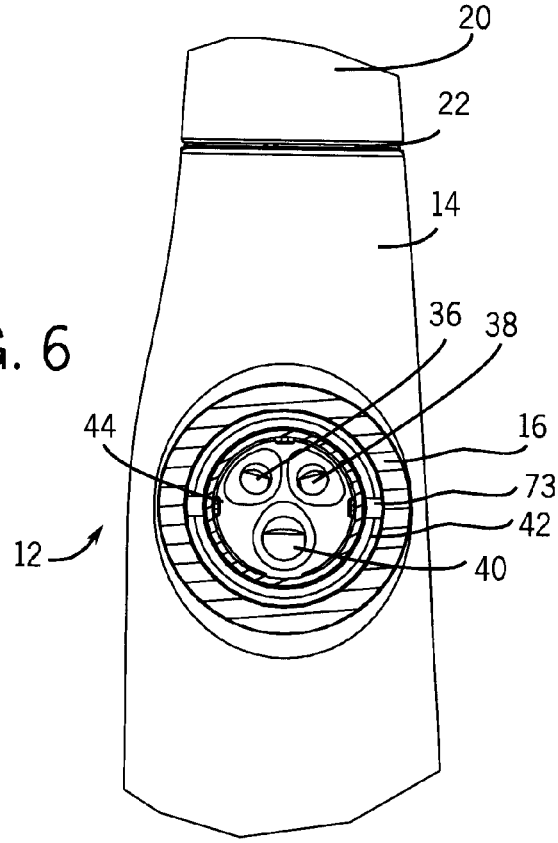
FIG. 6 is a cross-sectional view taken along line 6-6 of FIG. 2.

Referring next to FIG. 6, it can be seen that when the waterway 32 is properly aligned, the elbow will present termini of the inlets and the outlet at the waterway face 54. Corresponding holes, with seals, will be formed on the control valve cartridge.

To assemble the faucet, an upper portion of the waterway 32 is inserted into the lower inlet section 30 of the hollow main body 14 and the catch 42 is inserted into the hollow side arm 16. While the waterway 32 and the catch 42 are inside the housing 12, the waterway face 54 of the waterway 32 is inserted into the cutout 60 on the catch face 58.

The catch 42 is then rotated within the hollow side arm 16 such that the set of projections 62 on the catch 42 grip the undercut 56 of the waterway 32. A tool may engage the pair of slots 73 to rotate the catch 42 from within the hollow side arm 16. When the catch 42 is rotated to a first position in which the set of projections 62 of the catch engage the undercut 56 of the waterway 32 after the waterway face 54 is inserted, the waterway 32 is prevented from dropping out of the lower inlet section 30 of the faucet housing 12.

However, when the catch 42 is rotated to a second position in which the cutout 60 and the waterway face 54 are aligned, then the waterway face 54 may disengage the catch 42 and the waterway 32 is permitted to drop out of the lower inlet section 30 of the hollow main body 14. This connection between the rotational sleeve and the waterway is a bayonet-type assembly.

It should be appreciated that other types of connections may be used to connect the waterway face 54 to the catch 42. For example, the catch 42 and the waterway 32 may each have a set of threads that may engage one another when the catch 42 is rotated relative to the waterway 32.

Once the catch 42 is connected to the waterway 32, the waterway 32 is secured at a position adjacent to the hollow side arm 16. The flange 68 on the outer periphery 66 of the catch 42 contacts a step 78 on walls of the inner bore of the hollow side arm 16 to prevent the catch 42 from sliding all the way into the hollow main body 14. In this manner, once the connection between the catch 42 and the waterway 32 is formed, the waterway 32 is secured to the catch 42 at a point near the hollow side arm 16.

Once the waterway is secured, control valve cartridge 44 may be inserted into the bore 64 of the catch 42 such that the waterway face 54 abuts a valve face 74 of the control valve cartridge 44, placing the waterway 32 and the control valve cartridge 44 in fluid communication with one another. The usual seals between the waterway face 54 and the valve face 74 create a water-tight seal is formed around each of the connecting water channels.

The control valve cartridge 44 can then be secured in the hollow side arm 16 by fastening the bonnet nut 46 to the hollow side arm 16. As the bonnet nut 46 is fastened to the hollow side arm 16, the valve face 74 of the control valve cartridge 44 is firmly pressed against the waterway face 54 or seal located there between. Thus, the bonnet nut 46 helps to both retain the valve cartridge in the hollow side arm 16 and maintain the connection between the waterway 32 and the control valve cartridge 44.

Once the bonnet nut 46 is in place, the bonnet 48 may be placed on the end of the hollow side arm 16. As the valve stem 76 can extend through the bonnet nut 46 and the bonnet 48, the handle 18 is fastened to the valve stem 76 to permit operation of the control valve cartridge 44 using the handle 18.

The handle 18 may be used to operate the faucet 10. The handle 18 is capable of rotation about an axis of the hollow side arm 16 to control the temperature of the water. Further, the handle 18 may be tilted from a closed position (shown as solid lines in FIG. 2) to an open position (shown as phantom lines in FIG. 2) to control the flow rate of water from the faucet 10. Although one type of handle-valve control is described, it should be appreciated that other types of handle-valve control known to those skilled in the art may also be used.

Thus, the present invention permits easy insertion of the control valve and waterway assembly into a faucet housing. If maintenance of either is needed, they may easily be removed without having to remove the faucet from the counter top or the like.

Many modifications and variations to this preferred embodiment will be apparent to those skilled in the art, which will be within the spirit and scope of the invention. For example, if the control valve is merely for controlling either hot or cold water, only a single inlet line would be needed. Therefore, the invention should not be limited to the described embodiment. To ascertain the full scope of the invention, the following claims should be referenced

INDUSTRIAL APPLICABILITY

The invention provides a faucet having a waterway subassembly that can be easily installed and removed where the faucet is of the type having a side arm control valve system.

What is claimed is:

1. In a faucet comprising:

a housing having a hollow main body, a lower inlet, a hollow side arm, and an upper outlet;

a control valve mounted to the side arm; and a waterway removably mounted in the main body, the waterway having at least one inlet line, a waterway face positionable adjacent the control valve, and an outlet line;

the faucet further comprising:

a catch located in the side arm which is accessible from outside the side arm and moveable between a first position that prevents the waterway from dropping out the housing lower inlet and a second position that permits the waterway to drop out the housing lower inlet;

wherein the faucet is configured such that if the faucet is installed on a countertop and the catch is moved from the first position to the second position, the waterway can be removed downward out of the housing while the faucet is still installed on the countertop.

2. The faucet of claim 1, wherein the catch is in a form of a rotatable sleeve.

3. The faucet of claim 2, wherein the rotatable sleeve has a projection.

4. The faucet of claim 3, wherein the waterway face has an undercut that the projection can grip when the projection is in a first rotational position.

5. The faucet of claim 1, wherein the control valve is in a form of a valve cartridge located in the side arm radially inward of the catch.

6. The faucet of claim 5, wherein a face of the valve cartridge abuts the waterway face.

7. The faucet of claim 6, further comprising a bonnet nut securing the valve cartridge in the side arm.

8. The faucet of claim 1, wherein the waterway has two such inlet lines linked to an elbow.

9. In a faucet comprising:

a housing having a hollow main body, a lower inlet, a hollow side arm, and an upper outlet;

a control valve mounted to the side arm; and a waterway removably mounted in the main body, the waterway having at least one inlet line, a waterway face positionable adjacent the control valve, and an outlet line;

the faucet further comprising:

a catch located in the side arm which is accessible from outside the side arm and moveable between a first position that prevents the waterway from dropping out the housing lower inlet and a second position that permits the waterway to drop out the housing lower inlet, wherein the catch forms a part of a bayonet type assembly.

* * * * *